US011369839B2

(12) United States Patent
Mrzlak

(10) Patent No.: US 11,369,839 B2
(45) Date of Patent: Jun. 28, 2022

(54) ADJUSTABLE BALANCE BOARD TRAINING SYSTEM

(71) Applicant: REVOLUTION BOARDS LLC, Denver, NC (US)

(72) Inventor: Brendon Mrzlak, Denver, NC (US)

(73) Assignee: REVOLUTION BOARDS LLC, Denver, NC (US)

( * ) Notice: Subject to any disclaimer, the term of this patent is extended or adjusted under 35 U.S.C. 154(b) by 157 days.

(21) Appl. No.: 16/580,355

(22) Filed: Sep. 24, 2019

(65) Prior Publication Data

US 2020/0094107 A1 Mar. 26, 2020

Related U.S. Application Data

(60) Provisional application No. 62/736,289, filed on Sep. 25, 2018.

(51) Int. Cl.

| | |
|---|---|
| ***A63B 22/16*** | (2006.01) |
| ***A63B 21/00*** | (2006.01) |
| ***A63B 71/00*** | (2006.01) |

(52) U.S. Cl.

CPC ..... *A63B 22/16* (2013.01); *A63B 21/4034* (2015.10); *A63B 2071/0072* (2013.01); *A63B 2208/0204* (2013.01); *A63B 2225/09* (2013.01)

(58) Field of Classification Search

CPC ..... A63B 21/0004; A63B 21/00058; A63B 21/00069; A63B 21/00072; A63B 21/00076; A63B 21/002; A63B 21/0023; A63B 21/0615; A63B 21/0616; A63B 21/0617; A63B 21/068; A63B 21/15; A63B 21/159; A63B 21/22; A63B 21/4027; A63B 21/4033; A63B 21/4034; A63B 21/4045; A63B 21/4047; A63B 21/4049; A63B 22/0046; A63B 22/16; A63B 22/18; A63B 22/20; A63B 22/201; A63B 22/203; A63B 26/00; A63B 26/003; A63B 71/0054; A63B 2071/0072; A63B 2208/0204; A63B 2209/00; A63B 2209/08; A63B 2209/10; A63B 2225/09

See application file for complete search history.

(56) References Cited

U.S. PATENT DOCUMENTS

| | | | | |
|---|---|---|---|---|
| 3,389,910 A * | 6/1968 | Kanzler, Jr. | ..... | A63B 22/16 273/449 |
| 3,488,049 A * | 1/1970 | Martin, Jr. | ..... | A63B 22/16 482/146 |
| 3,806,116 A * | 4/1974 | Malmberg | ..... | A63B 22/14 482/147 |
| 3,862,768 A * | 1/1975 | England | ..... | A63B 22/18 280/205 |

(Continued)

*Primary Examiner* — Gary D Urbiel Goldner

(57) ABSTRACT

A balance board system, comprising, a rotatable roller, a balance board having a lower surface that sits atop the rotatable roller and reciprocally rides on the rotatable roller, the balance board lower surface having a plurality of attachment points, a plurality of board connectors disposed at the plurality of attachment points, a plurality of stop connectors and a plurality of roller stops coupled to at least two of the plurality of stop connectors, the plurality of roller stops are attachable to the balance board at a respective one of the plurality of attachment points.

18 Claims, 5 Drawing Sheets

(56) References Cited

U.S. PATENT DOCUMENTS 3,895,794 A * 7/1975 England ..... B62K 1/00 482/146
4,826,159 A † 5/1989 Hersey
5,152,691 A * 10/1992 Moscarello ..... A63B 22/16 434/247
6,916,276 B1 † 7/2005 Robinson
7,300,392 B1 * 11/2007 Curran ..... A63B 21/0004 482/146
7,775,952 B1 * 8/2010 Curran ..... A63B 26/003 482/146
9,387,363 B1 * 7/2016 Polinsky ..... A63B 22/18
9,750,980 B1 † 9/2017 Khalili
10,080,945 B2 9/2018 Brown
10,315,065 B1 * 6/2019 Soba ..... A63B 21/151
10,376,070 B1 * 8/2019 Jen ..... A47C 3/18
2004/0063556 A1 * 4/2004 Wischusen ..... A63B 26/003 482/148
2006/0270536 A1 * 11/2006 Tukada ..... A63B 26/003 482/146
2007/0027010 A1 * 2/2007 Tsai ..... A63B 21/0004 482/146
2009/0197748 A1 * 8/2009 Smith ..... A63B 69/0093 482/146
2011/0072581 A1 * 3/2011 Villa ..... A63B 21/4037 5/420
2011/0136636 A1 * 6/2011 Canton ..... A63B 22/16 482/146
2012/0252645 A1 * 10/2012 Agostini ..... A63B 21/0004 482/132
2013/0123077 A1 * 5/2013 Dun ..... A63B 22/18 482/139
2013/0252792 A1 * 9/2013 Brown ..... A63B 22/16 482/146
2014/0011651 A1 * 1/2014 Brown ..... A63B 26/003 482/146
2015/0251056 A1 * 9/2015 Crist ..... A63B 22/18 482/146
2016/0310792 A1 * 10/2016 Smith ..... A63B 22/16
2018/0001143 A1 * 1/2018 Brown ..... A63B 69/0093
2018/0133553 A1 * 5/2018 Kramer ..... A63B 21/4033

* cited by examiner
† cited by third party

ADJUSTABLE BALANCE BOARD TRAINING SYSTEM

TECHNICAL FIELD OF THE APPLICATION

This application relates to a balance board system that is used for exercise, recreation and training for sports and fitness where the distance and direction that may be traveled along on the roller of the balance board that is quickly and selectively adjustable using a removably adhered roller stop system. For more advanced users, the stops are easily, but temporarily removed to offer unlimited roller angles and positions.

BACKGROUND OF THE APPLICATION

A balance board is a device that replicates the feel and motor skills associated with board-sports such as surfing, snowboarding, skateboarding, more traditional sports like hockey and basketball, or used and a fitness and workout device. The board is typically longer than it is wide and rides on top of a pivot. The pivot is typically a roller of constant radius that rolls along a variety of axes and allows the rider to move in a side-to-side rolling, see-saw type motion.

In one example axis configuration, with the roller positioned perpendicular to the board lengthwise offers training between the left and right side of the body. In a second example axis configuration, the roller is positioned parallel to the board lengthwise and offers heel to toe balance training for the user. These configurations simulate different conditions often experienced a variety of activities.

In this way the muscles and skills necessary to balance are utilized allowing a user to develop motor skills applicable to board-sports and other activities, and exercise at the same time.

The rolling of the roller along each axis may be limited by stops placed at various positions and directions along the bottom surface of the board. Typically, a pair of elongated stops is used. The stops prevent the board from falling off the roller, and provide guidance for the user as to the location of the roller under the board. Changing the rolling distance between the stops also varies the difficulty experienced by the user, as a longer rolling distance provides more of a challenge. A shorter rolling distance provides less range of motion, and is more suitable for beginners. For more advanced users, the stops are easily, but temporarily removed to offer unlimited roller angles and positions free from restrictions. Currently, these roller stops may not be adjusted or removed, or, must be mechanically adjusted with the use of tools.

Prior art devices have roller stops that tend to be unduly cumbersome or do not allow movement from position to position in order to change the range of travel or modify the roller stop direction. This results in a time-consuming process of changeover that requires the use of tools.

Therefore, there exists a need for a balance board that has an easily changed variable range of travel with respect to the roller. The balance board design should allow a rapid modification from one range of travel to another or from one axis of travel to another without the need for tools and to make the travel modification easy to use by the user and that positively holds the roller stops to the board during use.

SUMMARY OF THE APPLICATION

A first example embodiment of the present application provides at least one of a balance board system, comprising, a rotatable roller, a balance board having a lower surface that sits atop the rotatable roller and reciprocally rides on the rotatable roller, the balance board lower surface having a plurality of attachment points, a plurality of board connectors disposed at the plurality of attachment points, a plurality of stop connectors and a plurality of roller stops coupled to at least two of the plurality of stop connectors, the plurality of roller stops are attachable to the balance board at a respective one of the plurality of attachment points.

A second example embodiment of the present application provides at least one of a balance board system, comprising, a rotatable roller, a balance board having a lower surface that sits atop the rotatable roller and reciprocally rides on the rotatable roller, the balance board lower surface having a plurality of pairs of cavities wherein the pairs of cavities are equidistant and on opposite sides of a central axis of the balance board, a plurality of magnetically attractive board connectors disposed within the plurality of pairs of cavities, a plurality of magnetically attractive stop connectors and a pair of roller stops coupled to the plurality of magnetically attractive stop connectors, the pair of roller stops are magnetically attachable to the balance board at a respective one of the plurality of pairs of cavities.

A third example embodiment of the present application provides at least one of a balance board system, comprising, a rotatable roller, a balance board having a lower surface that sits atop the rotatable roller and reciprocally rides on the rotatable roller, the balance board lower surface having a plurality of pairs of bores wherein the pairs of bores are equidistant and on opposite sides of a central axis of the balance board, a plurality of board magnets disposed within the plurality of pairs of bores, a plurality of stop magnets and a pair of roller stops coupled to the plurality of stop magnets, the pair of roller stops are magnetically attachable to the balance board at a respective one of the plurality of pairs of bores to limit a range of travel of the balance board.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
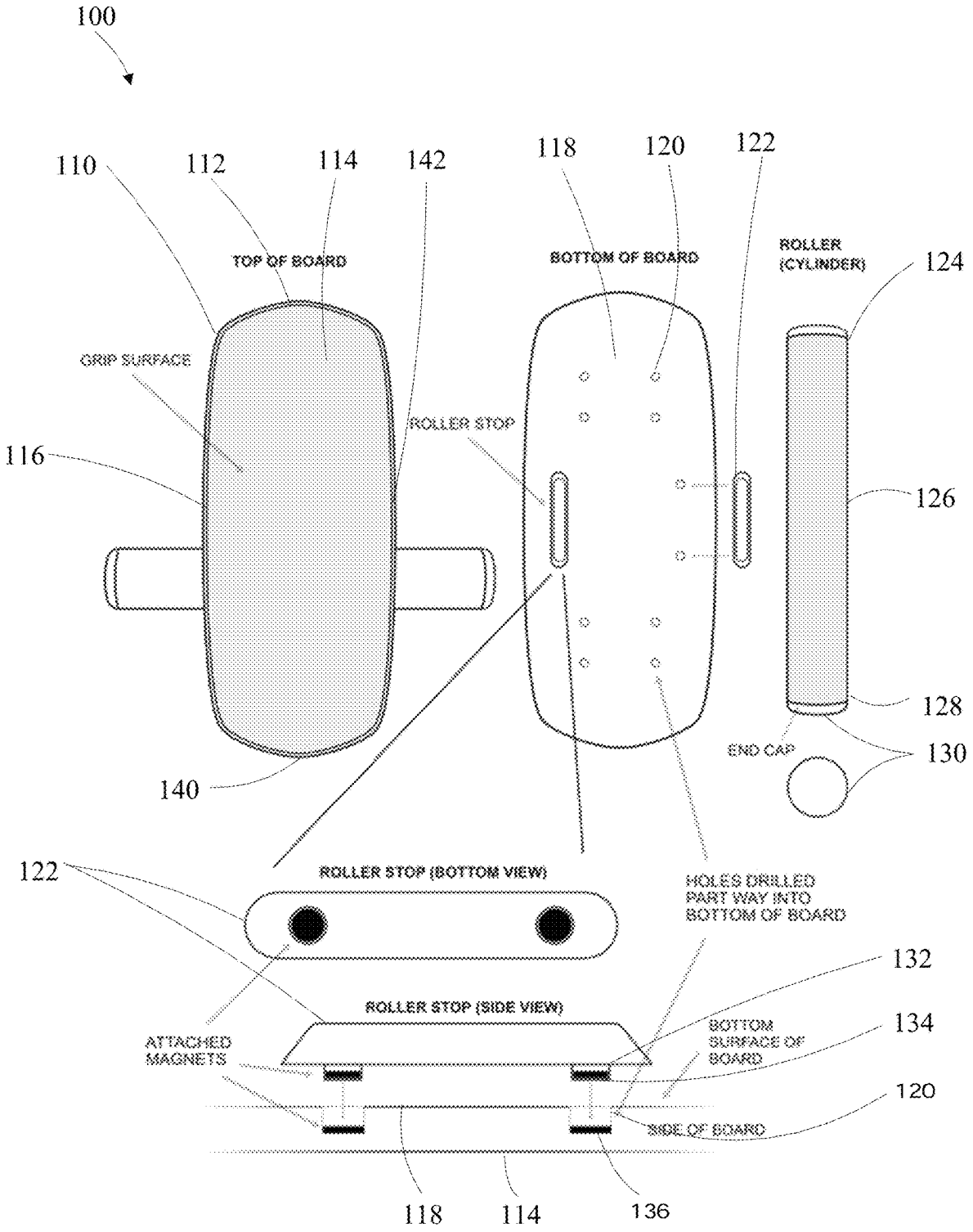
FIG. 1 depicts a first example of the balance board system, in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE APPLICATION

It will be readily understood that the components of the present disclosure, as generally described and illustrated in the figures herein, may be arranged and designed in a wide variety of different configurations. Thus, the following detailed description of the examples of a system, as represented in the attached figures, is not intended to limit the scope of the disclosure as claimed, but is merely representative of selected examples of the disclosure.

The features, structures, or characteristics of the disclosure described throughout this specification may be combined in any suitable manner in one or more examples. For example, the usage of the phrases "examples", "some examples", or other similar language, throughout this specification refers to the fact that a particular feature, structure, or characteristic described in connection with the example may be included in at least one example of the present disclosure. Thus, appearances of the phrases "examples", "in some examples", "in other examples", or other similar language, throughout this specification do not necessarily refer to the same group of examples, and the described features, structures, or characteristics may be combined in any suitable manner in one or more examples.

The overall components of the system include a board, a roller and at least one pair of removably adhered roller stops. A plurality of defined attachment positions for these roller stops are located on the bottom surface of the board, allowing for multiple stop positions to be chosen by the user.

FIG. 1 depicts an example balance board system 100, in accordance with an embodiment. The balance board 110, has a nose 112, a tail 140, rails 116 and 142, a board upper surface 114 and a board lower surface 118. The system also has a cylindrically shaped roller 126 having end portions 124 and 128 and end caps 130 connected to the end portions. The rider stands on the top surface of the board, with the board lower surface pivoting on the roller. The rider may have the roller placed lengthwise between the rails and pivot left and right, may have the roller placed between the nose and the tail and pivot on the board from front to back or may have the roller at an angle to the nose and rails. This embodiment includes a roller of length similar to the board length, which provides more stability to the rider when used parallel to the board, and also more readily simulates conditions often found in various board-sports. The term board and balance board are used interchangeably within the disclosure.

The board may be flat or slightly curved and the board upper surface may have a non-slip surface. The non-slip covering may be textured, foam, rubber, grip tape and the like. The board itself may be made of a rigid material like wood, hard plastic, fiberglass and the like. In general, the board is designed to be resilient, strong and slightly flexible and may have grip surfaces on the board upper surface and or the board lower surface.

Likewise, the roller may have a constant diameter or have a slight taper from the center to the edge of the roller and may have a non-slip surface on its outer rolling surface. The non-slip covering may be textured, foam, rubber, grip tape and the like. The roller may also be made of a rigid material like wood, hard plastic, fiberglass and the like. In general, the roller is designed to be resilient, strong and slightly flexible and may have a grip surface at its outer diameter.

On the board lower surface 118, are a series of blind bores 120 that are at spaced intervals. The blind bores 120 have within them board magnets 136 or magnetically attractive board connectors. The board magnets or magnetically attractive board connectors may be screwed into the board, glued it, molded in or fastened in. The magnets themselves may be of the rare earth type, a mixture of ceramic and rare earth materials, magnetized iron and the like. The blind bores may be orthogonal or non-orthogonal to other equidistantly spaced blind bores.

In alternate embodiments, the blind bores may have located within them hook and loop fasteners such as Velcro®, or may have a slight interference fit, or friction fit to the roller stop posts. In other embodiments, the blind bores may be threaded, have removable adhesive, spring detents with complementary post grooves, inset threaded couplers, thumbscrews, have rubber-like material disposed along the inside of the bore to hold the post in position, have a complementary keyed interlock and the like.

The system also includes roller stops 122 that have a pair of posts 132 and the end of the posts have stop magnets 134 connected to them. The stop magnets or magnetically attractive stop connectors may be screwed into the posts, glued to it, molded into or simply fastened to it. The stop magnets themselves may be of the rare earth type, a mixture of ceramic and rare earth materials, magnetized iron and the like. In this system a magnetic adhesion is sought between the board and the roller stops, this may take the form of stop magnets adhered to board magnets, or a board or stop magnet on either the board or the roller stop adhered to a magnetically attractive material on the other portion.

In alternate embodiments the posts may have located at their apex hook and loop fasteners such as Velcro®, or may have a slight friction interference fit or friction fit with the blind bores. In other embodiments, the posts may be threaded complementary to the blind bores, may have removable adhesive, spring detents complementary to bore groves, removable adhesive, thumbscrews, inset threaded couplers, have rubber like material disposed at the outer diameter of the post to hold the post in the bore, have a complementary keyed interlock and the like.

In one embodiment, the stop magnets on the ends of the roller stop posts adhere to the board magnets 136 that are contained within the blind bores for added pull strength. In other embodiments, magnets may be embedded in either or both the roller stop or the board, or, one could have a magnet and a magnetically attractive insert such as iron or ferrous based material.

The spaced intervals on the board lower surface allow insertion of a set of roller stops 122 having stop magnets, into the blind bores. This insertion of a portion of the roller stops into the blind bores allows the stop magnet to grab onto the board magnet or grab onto the magnetically attractive material and allows a firm grip of the roller stop onto the board lower surface. These stop and board magnets allow quick and secure removable attachment of the roller stops to the board without the need for tools.

Roller stops may be placed at a 45 degree angle, in those embodiments where the hole pattern in the board provides that type of alignment. In general, the roller since it is a separate piece may be used at any angle to the board even if the stops are in their standard position. The roller stops can be easily and temporarily removed so that the roller may travel farther in any direction and without restriction to the user, but without the guidance and safety benefit that the roller stops provide. This configuration is suitable for more advanced users with higher balance skill levels.

In one embodiment, the roller stops 122 may have a tapered or sloped surface which may contact the roller tangentially. The angle of the tapered surface to the board lower surface may be between 20 and 70 degrees, but in a preferred embodiment is approximately 30 degrees. The height of the stop, extending from the base of the board may vary from 0.2 inch to 3 inches. The stop may sit flush to the base of the board, or touch only at the connection points. The shape of the stop is typically elongated with a length of between and 1 and 15 inches, and a width of between 0.5 to 5 inches.

The stop is typically symmetrical in shape when seen from the top, or front. This allows the stop to function without regard to orientation, and therefore, the user does not need to be concerned with correct rotation when adjusting the stop position or angle.

The stop may be constructed of a resilient material such as molded plastic, machined metal, plastic, wood or the like. The elongated shape provides a large area of surface contact with the roller to increase stability.

The stop shape also allows it to be readily grasped by hand to allow for quick repositioning by the user. The stop may also have a padded rubber, or complaint exterior covering to dampen sound and vibration created by board contact with the floor or the roller.

The board upper surface may have a non-slip surface such as a textured surface, or a compliant material such as cork, rubber and the like. The reason for the non-slip surface is for the user to be able to concentrate on balancing without slipping on the board, and for user comfort.

Figure 2:
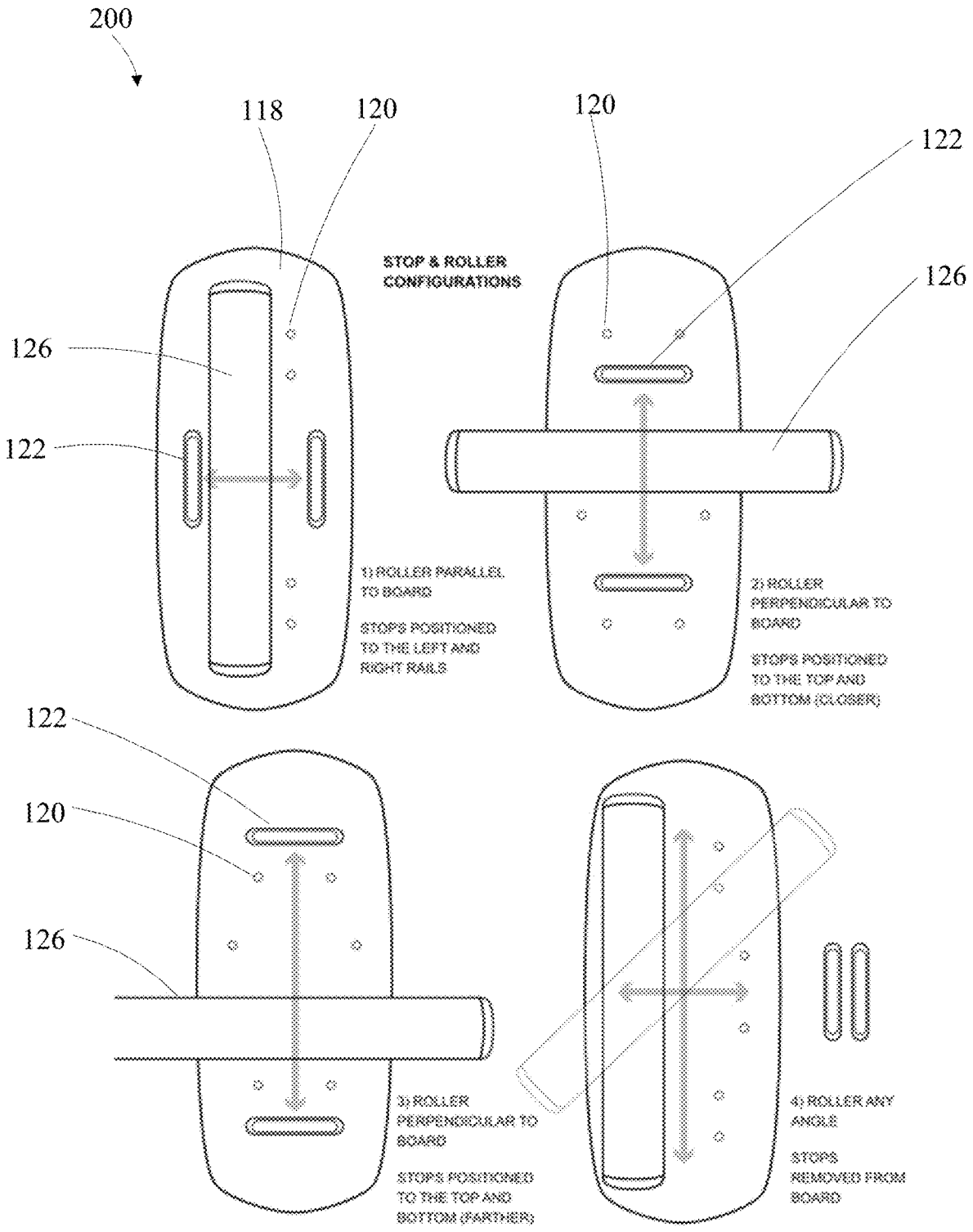
FIG. 2 depicts a second example of the balance board system, in accordance with some embodiments.

FIG. 2 depicts another embodiment in which the blind bores 120 are spaced differently than in FIG. 1 and allow further movement of the roller on the board. The blind bores may be along the sides of the board, allowing the user to pivot along an axis parallel to the sides. The blind bores may be spaced along the nose and tail edges of the board allowing the user to pivot front to back. In one embodiment, the blind bores may be placed at an angle to both the axis defined by the nose and tail, and also the rails. In this way the board may be ridden at an angle while still having the roller stops limiting the motion of the board.

Figure 3:
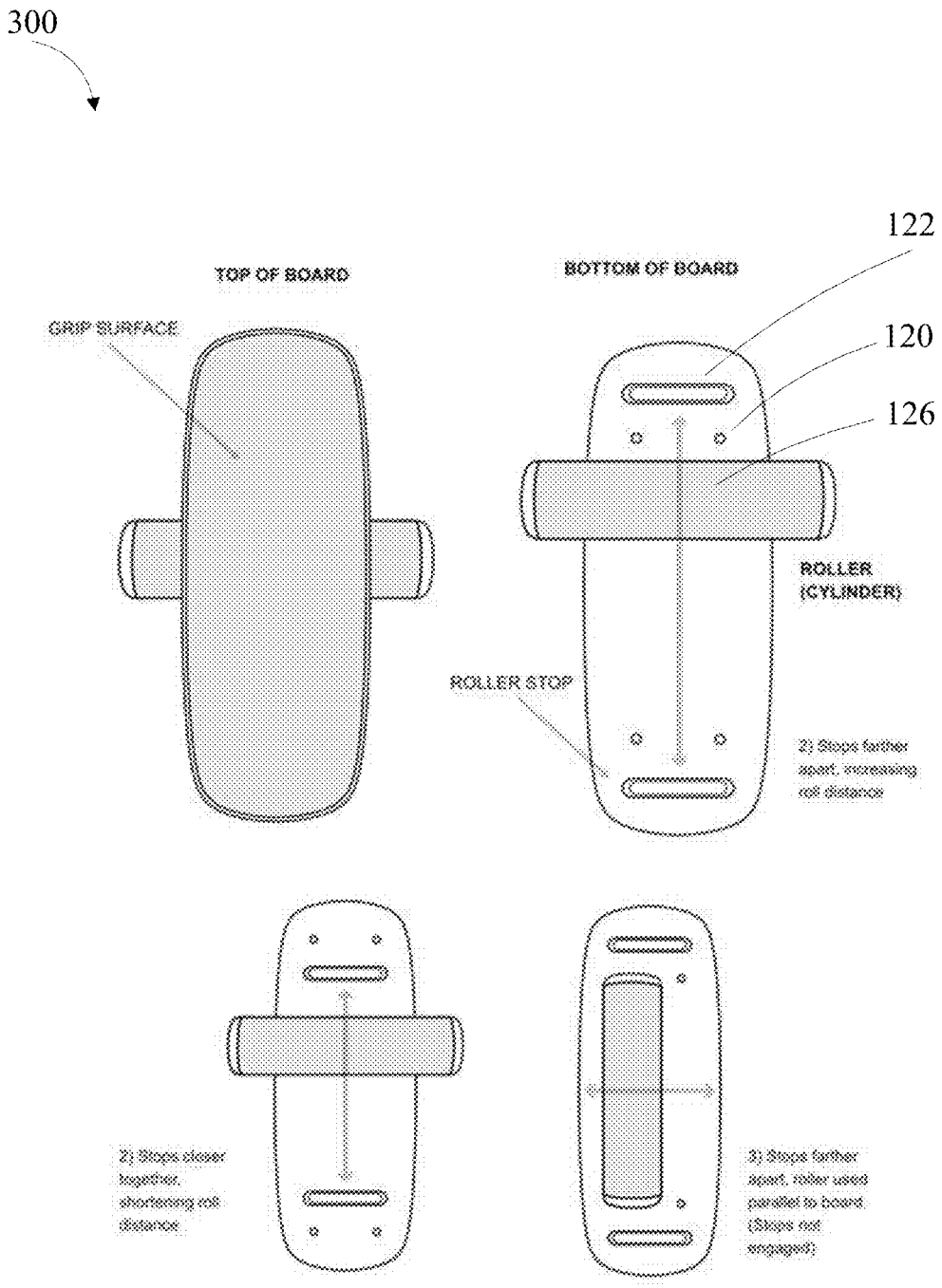
FIG. 3 depicts a third example of the balance board system, in accordance with some embodiments.

FIG. 3 depicts yet another embodiment in which the blind bores 120 are spaced differently than in FIGS. 2 and 3. In each of these configurations the roller stop posts have a stop magnet which may adhere to a board magnet within the blind bores. This embodiment allows a shorter roller, with respect to the length of the board, to engage the stops when positioned perpendicular, and to roll freely between them when positioned parallel to the board. In this particular embodiment, there are no blind bores or stops mounted parallel to the left and right rails of the base of the board, leaving the blind bores located proximate the nose and tail.

In one embodiment the rotatable roller has a rigid inner portion and a compliant outer portion and end caps. The length of the roller is preferentially between 50% and 110% of the length of the board from nose to tail. The roller diameter may be between 10% and 60% of the length of the roller.

Figure 4:
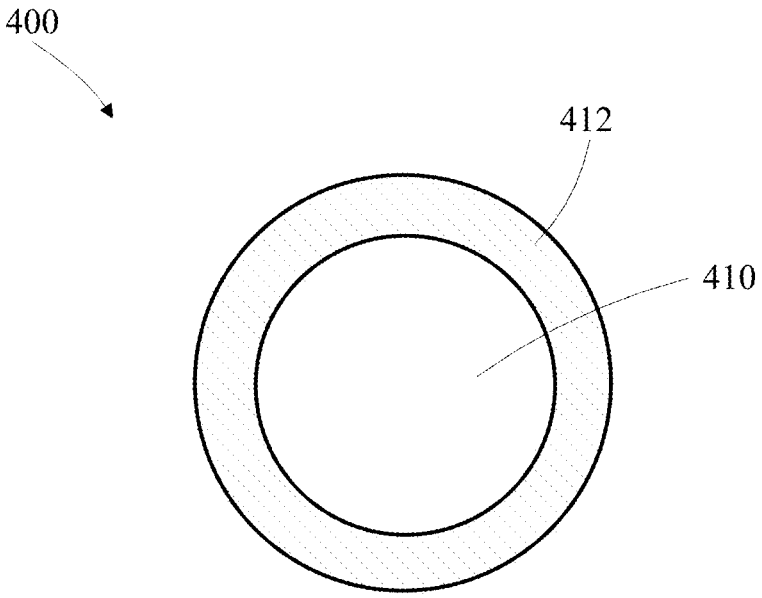
FIG. 4 depicts an example two portion roller, in accordance with some embodiments.
Figure 5:
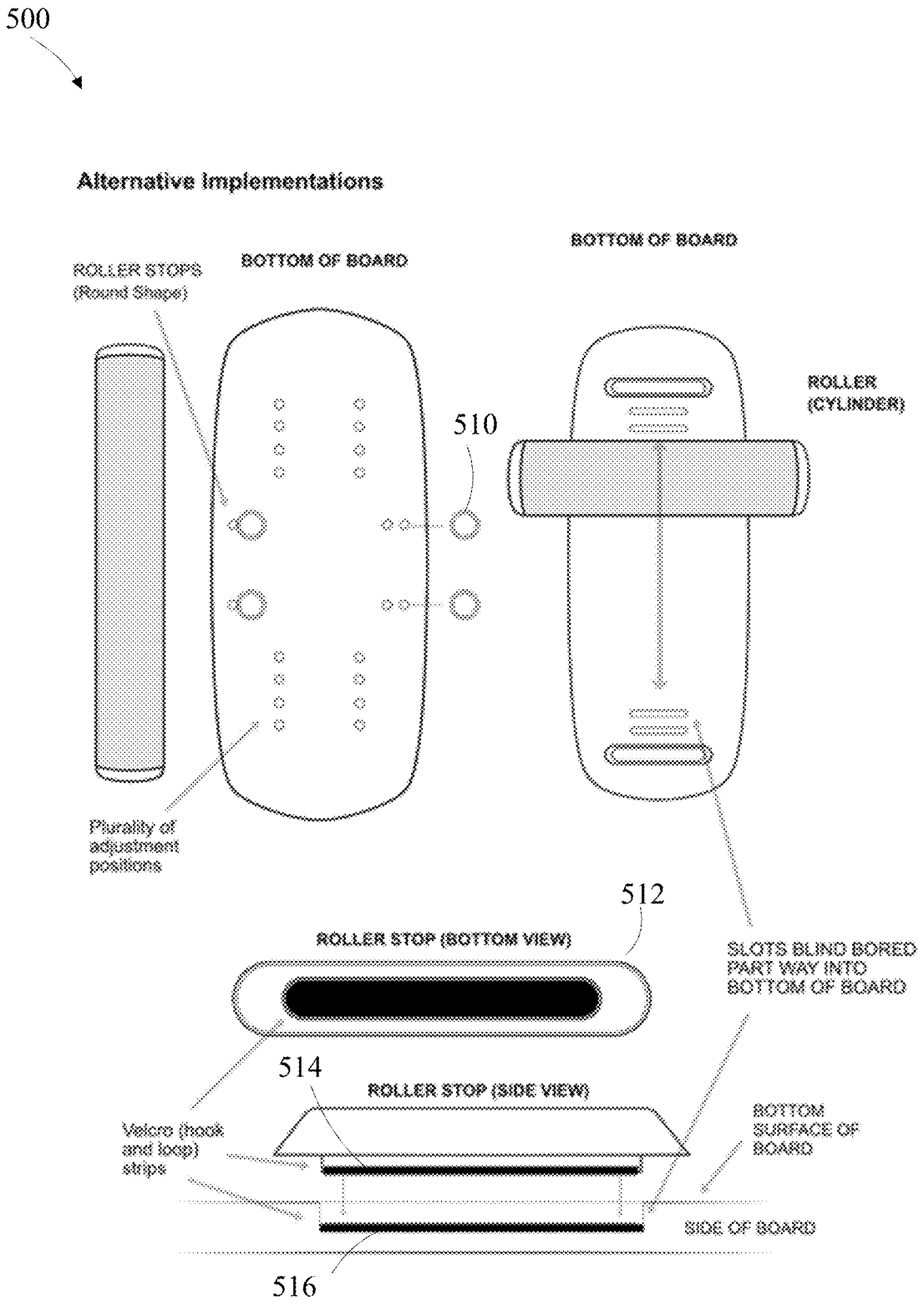
FIG. 5 depicts a fourth example of the balance board system, in accordance with some embodiments.

FIG. 4 depicts the cross section of a roller having an inner portion 410 and an outer portion 412 which have different material characteristics. In one embodiment the inner portion or core is resilient and the outer portion or cover is compliant. This allows for more gradual movement of the roller with respect to the board. The outer portion may also be rigid, but having a compliance greater than the inner portion. The end caps have the effect of adding strength to the roller and may be made of plastic, wood, metal or the like.

Since the board is flat in a preferred embodiment, the design has a roller with a single diameter. In other embodiments, a larger diameter in one area may be provided due to additional materials being used on the roller for specific grip regions. In general the roller is designed to be resilient, strong, and has a grip or texture on the exterior. The surfaces hardness could also be adjusted with different materials.

The board lower surface may have lower traction areas near both the nose and the tail of the board. The lower traction areas of the board may interact with the roller outer portion to provide a doubly cushioned area near the edges of movement to give the rider a tactile feedback of his position before the roller stops are encountered.

In another embodiment a balance board system, comprising, a rotatable roller, a balance board having a lower surface that sits atop the rotatable roller and reciprocally rides on the rotatable roller, the balance board lower surface having a plurality of attachment points, a plurality of board connectors disposed at the plurality of attachment points, a plurality of stop connectors and a plurality of roller stops coupled to at least two of the plurality of stop connectors, the plurality of roller stops are attachable to the balance board at a respective one of the plurality of attachment points. The roller stops may be round 510 or elongated 512 and the attachment points may be bores or grooves within the balance board and extensions on the roller stops.

The plurality of stop connectors are threadably connected, hook 514 and loop 516 connected, interference connected, key connected, spring and detent connected, magnetically connected and the like to the plurality of board connectors. Each type of connector allows easy manual change outs from one configuration to another, without the need for tools to facilitate the change.

In a further embodiment, a balance board system, comprising, a rotatable roller, a balance board having a lower surface that sits atop the rotatable roller and reciprocally rides on the rotatable roller, the balance board lower surface having a plurality of pairs of cavities wherein the pairs of cavities are equidistant and on opposite sides of a central axis of the balance board, a plurality of magnetically attractive board connectors disposed within the plurality of pairs of cavities, a plurality of magnetically attractive stop connectors and a pair of roller stops coupled to the plurality of magnetically attractive stop connectors, the pair of roller stops are magnetically attachable to the balance board at a respective one of the plurality of pairs of cavities.

The magnetically attractive board connectors may be magnets or ferrous and the magnetically attractive stop connectors may be ferrous or magnetic respectively. The cavities may be defined by a bore, a groove and the like.

In yet another embodiment, a balance board system, comprising, a rotatable roller, a balance board having a lower surface that sits atop the rotatable roller and reciprocally rides on the rotatable roller, the balance board lower surface having a plurality of pairs of bores wherein the pairs of bores are equidistant and on opposite sides of a central axis of the balance board, a plurality of board magnets disposed within the plurality of pairs of bores, a plurality of stop magnets and a pair of roller stops coupled to the plurality of stop magnets, the pair of roller stops are magnetically attachable to the balance board at a respective one of the plurality of pairs of bores to limit a range of travel of the balance board.

Although an example of the system of the present disclosure has been illustrated in the accompanied drawings and described in the foregoing detailed description, it will be understood that the application is not limited to the examples disclosed, and is capable of numerous rearrangements, modifications, and substitutions without departing from the spirit or scope of the disclosure as set forth and defined by the following claims.

While preferred examples of the present disclosure have been described, it is to be understood that the examples described are illustrative only and the scope of the disclosure is to be defined solely by the appended claims when considered with a full range of equivalents and modifications thereto.

What is claimed is:

1. A balance board system, comprising:

a balance board having an upper surface for engaging a foot of a user and a lower surface having a plurality of attachment points formed in the lower surface;

a roller to engage the lower surface;

a plurality of board connectors, each board connector disposed in a corresponding one attachment point of the plurality of attachment points;

a plurality of roller stops, each roller stop comprising:

a top surface oriented towards a ground surface during use;

an engagement surface having a plurality of stop connectors to be received by corresponding attachment points of the plurality of attachment points, and tapered side surfaces each having an angle of between 20 degrees and 70 degrees with respect to the lower surface of the balance board to engage the roller during use.

2. The balance board system of claim 1, wherein the plurality of stop connectors are threadably connected to the plurality of board connectors.

3. The balance board system of claim 1, wherein the plurality of stop connectors are hook and loop connected to the plurality of board connectors.

4. The balance board system of claim 1, wherein the plurality of stop connectors are interference connected to the plurality of board connectors.

5. The balance board system of claim 1, wherein the plurality of stop connectors are keyably connected to the plurality of board connectors.

6. The balance board system of claim 1, wherein the plurality of stop connectors are spring detentably connected to the plurality of board connectors.

7. The balance board system of claim 1, wherein the plurality of stop connectors are magnetically connected to the plurality of board connectors.

8. The balance board system of claim 1, wherein at least two attachment points, of the plurality of attachment points, are placed non-orthogonally to remaining attachment points of the plurality of attachment points.

9. The balance board system of claim 1, wherein at least two attachment points, of the plurality of attachment points, are placed orthogonally to remaining attachment points of the plurality of attachment points.

10. The balance board system of claim 1, wherein the roller has one of:

a diameter that is one of larger at a central portion of the roller and smaller at an end portion of the roller, or a diameter that is smaller at the central portion of the roller and larger at the end portion of the roller.

11. The balance board system of claim 1, wherein the tapered side surfaces each having an angle of about 30 degrees.

12. A balance board system, comprising:

a balance board having an upper surface for engaging a foot of a user and a lower surface having a plurality of pairs of cavities formed in the lower surface, wherein the plurality of pairs of cavities are symmetrically arranged on opposite sides of a central axis of the balance board;

a roller to engage the lower surface;

a plurality of magnetic board connectors, each magnetic board connector disposed in a corresponding one cavity of the plurality of cavities;

a pair of roller stops, each roller stop comprising:

a top surface oriented towards a ground surface during use;

an engagement surface having a pair of magnetic stop connectors to be connected to a corresponding pair of magnetic board connectors; and tapered side surfaces each having an angle of between 20 degrees and 70 degrees with respect to the lower surface of the balance board to engage the roller during use.

13. The balance board system of claim 12, wherein each cavity of the plurality of pairs of cavities defines one of a bore or a groove.

14. The balance board system of claim 12, wherein the tapered side surfaces each having an angle of about 30 degrees.

15. A balance board system, comprising:

a balance board having an upper surface for engaging a foot of a user and a lower surface having a plurality of pairs of bores formed in the lower surface, wherein the plurality of pairs of bores are symmetrically arranged on opposite sides of a central axis of the balance board;

a roller to engage the lower surface;

a plurality of board magnets, each board magnet disposed in a corresponding one bore of the plurality of pairs of bores;

a pair of roller stops, each roller stop comprising:

a top surface oriented towards a ground surface during use;

an engagement surface having a pair of stop magnets to be connected to a corresponding pair of board magnets; and tapered side surfaces each having an angle of between 20 degrees and 70 degrees with respect to the lower surface of the balance board to engage the roller during use.

16. The balance board system of claim 15, wherein at least two pairs of bores, of the plurality of pairs of bores, are placed non-orthogonally to remaining pairs of bores of the plurality of pairs of bores.

17. The balance board system of claim 15, wherein at least two pairs of bores, of the plurality of pairs of bores, are placed orthogonally to remaining pairs of bores of the plurality of pairs of bores.

18. The balance board system of claim 15, wherein the tapered side surfaces each having an angle of about 30 degrees.

* * * * *